United States Patent [19]

Dunks et al.

[11] 4,238,231

[45] Dec. 9, 1980

[54] APPARATUS FOR TREATMENT OF MOLTEN METAL

[75] Inventors: Clifford M. Dunks, East Grinstead; Timothy Castledine, Ripley, both of England

[73] Assignee: Materials and Methods Limited, Surrey, England

[21] Appl. No.: 42,087

[22] Filed: May 24, 1979

[30] Foreign Application Priority Data

May 30, 1978 [GB] United Kingdom ..... 23798/78

[51] Int. Cl.[3] ..... C22C 33/08

[52] U.S. Cl. ..... 75/130 R; 75/53

[58] Field of Search ..... 75/53, 130 R

[56] References Cited

U.S. PATENT DOCUMENTS

| | | | |
|---|---|---|---|
| 3,703,922 | 11/1972 | Dunks | 75/130 R |
| 3,819,365 | 6/1974 | McCaulay | 75/130 R |
| 3,870,512 | 3/1975 | Lee | 75/130 R |
| 3,881,937 | 5/1975 | Teufel | 75/130 R |
| 4,040,821 | 8/1977 | Hetke | 75/130 R |
| 4,134,757 | 1/1979 | Roberts | 75/130 R |

*Primary Examiner*—P. D. Rosenberg

*Attorney, Agent, or Firm*—Armstrong, Nikaido, Marmelstein & Kubovcik

[57] ABSTRACT

The invention relates to an apparatus for the treatment of molten metal with a reactive additive.

The apparatus comprises a pouring cup having an outlet for introduction of both reactive additive and molten metal into a reaction chamber. The reaction chamber communicates via a channel, preferably of restricted cross-sectional area, with an expansion chamber provided with an outlet for the molten metal. The expansion chamber outlet has a smaller cross-sectional area than the pouring cup outlet thereby ensuring that the reaction chamber is sufficiently filled to cover any reactive additive during a pouring treatment. The apparatus permits a series of pourings to be effected without disassembly of the apparatus to introduce more reactive additive.

6 Claims, 3 Drawing Figures

APPARATUS FOR TREATMENT OF MOLTEN METAL

This invention relates to an apparatus for the treatment of molten metals, in particular for the treatment of grey iron with a nodularizer for the production of nodular iron.

In out U.K. Specification No. 1,311,093 there is described and claimed a process and apparatus for the treatment of molten metals. In the apparatus described in that specification the additive with which the molten metal is to be treated is introduced into a reaction chamber provided with a separate inlet for the molten metal. In operation a removable lid has to be removed before additive is positioned in the reaction chamber and then has to be replaced before the molten metal is run into the reaction chamber. This operation may have to be conducted under high temperature conditions and can lead to complications.

It is an object of the present invention to provide apparatus for carrying out the process described in our said prior specification which is designed to ensure that, for a given flow rate of the molten metal, sufficient molten metal is always present in the reaction chamber at least to cover the additive. Another object is to provide an apparatus which permits introduction of the addition through the same inlet as the metal to be treated thereby avoiding the provision of a separate inlet for the additive, in particular of the sort described in our said prior specification.

According to the present invention there is provided an apparatus for the treatment of molten metal with a reactive additive comprising a reaction chamber and a pouring cup, the pouring cup having an outlet communicating with the reaction chamber for introduction into the reaction chamber of reactive additive and molten metal, an expansion chamber communicating via a channel with the reaction chamber and provided with an outlet for molten metal wherein the cross-sectional area of the outlet from the expansion chamber is less than the cross-sectional area of the outlet from the pouring cup such that molten metal flows through the reaction chamber at a rate which ensures that the reaction chamber is filled to an extent sufficient to cover any reactive additive contained therein.

In the apparatus according to the invention, the arrangement wherein the outlet from the expansion chamber is smaller than the outlet from the cup ensures that the reaction chamber is filled to an extent to cover any additive contained therein. The expansion chamber outlet may, for example, have a cross-sectional area which is 10% smaller than the cup outlet.

According to a preferred embodiment, the maintenance of a quantity of molten metal in the reaction chamber sufficient at least to cover any reactive additive contained therein is assisted by means for restricting the flow of molten metal from the reaction chamber to the expansion chamber. This may be provided, for example, by a channel of restricted cross-sectional area leading directly from the reaction chamber to the expansion chamber. Alternatively, the apparatus may comprise an arrangement of refractory tiles, preferably two tiles, disposed between the reaction chamber and expansion chamber and between which molten metal is caused to flow. The width of the channel formed between the two tiles may be adjusted as necessary to provide the desired restriction in the flow of molten metal.

According to the present invention, the reaction chamber is provided with a single inlet for introduction of both the reactive additive and the molten metal. Conveniently the reaction chamber is disposed immediately below the pouring cup which arrangement ensures that molten metal covers the reactive additive immediately it is introduced into the reaction chamber. Thus, the apparatus according to the present invention permits a series of pourings to be carried out without any need to disassemble the apparatus after each individual pouring. This is in contrast to the apparatus described in U.K. Specification No. 1,311,093 where a cover has to be removed after each pouring in order to introduce the reactive additive required for a subsequent treatment. According to the present invention, the apparatus, which is made in two parts, need only be disassembled for periodic maintainance and cleaning. Thus, the present invention provides an apparatus which permits a series of metal treatments to be carried out in efficient and economical manner.

The invention also provides a process for the treatment of molten metal with a reactive additive which comprises introducing a reactive additive via a pouring cup and a first outlet into a reaction chamber, introducing molten metal via the said pouring cup and the said first outlet into the reaction chamber, causing the molten metal containing reactive additive to flow from the reaction chamber via a restricted channel into an expansion chamber, causing the molten metal to flow from the expansion chamber via a second outlet of cross-sectional area less than that of the said first outlet whereby the flow of molten metal is controlled such that the reaction chamber is filled with molten metal to an extent sufficient to cover any reactive additive contained therein.

The invention is particularly described with reference to the nodularisation of cast irons but the apparatus may be used for the efficient introduction of any metal, alloy or compounds into a molten metal.

The reaction chamber may be constructed of any refractory material or fabricated in metal lined with refractory material.

When the molten metal comes into contact with the nodulariser the reaction commences uniformly. The reaction continues progressively until all the nodulariser has been dissolved. Due to the fact that the reaction commences immediately the molten metal covers the nodulariser, solution occurs out of contact with air, hence volatilisation and oxidation are completely eliminated during processing. In some cases it may be advantageous to maintain an inert atmosphere in the chamber. Further the usual pyrotechnics, fume, and metal splashing which normally accompany the introduction of nodularisers are also eliminated. Hence it is now possible accurately to control the precise amount of additive which is required to improve the physical properties and change the base microstructure. This then eliminates the danger of conventional processes due to dross inclusions and over-treatment.

For example we have achieved complete conversion of the graphite form from flake to perfect spheroidal shape with as little as 0.15% of the nodulariser alloy used in accordance with the invention. A preferred range for such additions is from 0.15 to 0.5%. With any of the conventional techniques previously employed, it would have been necessary to use at least 0.5% of the same additive.

In this process, any of the well-known nodularising metals, alloys, compounds or mixtures thereof may be used in lump form, as crushed aggregate, in powder form, or as extruded or compacted/bonded shapes such as in the form of a unitary block. The size and shape will be dictated according to the nature of the reagent and the rate of solution control required.

Reference is made to the accompanying drawings wherein

Figure 1:
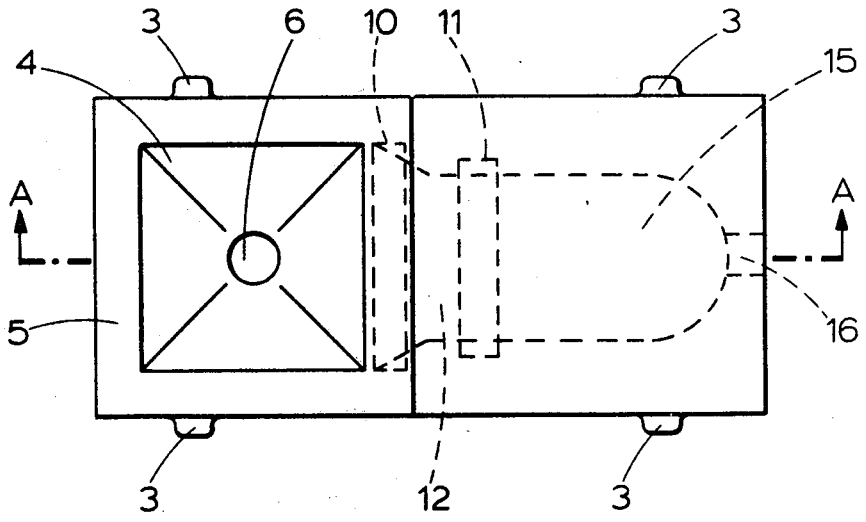
FIG. 1 is a plan view of one embodiment of an apparatus according to the invention.
Figure 2:
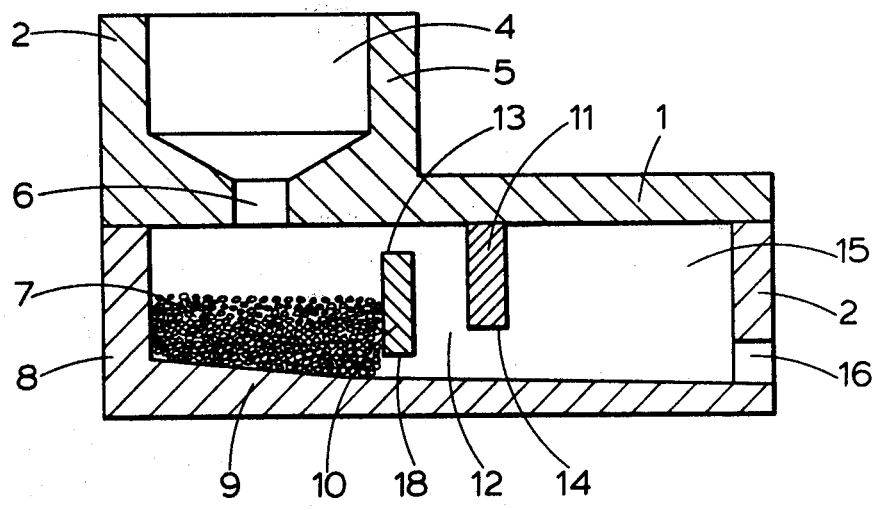
FIG. 2 is a section along the line A—A of FIG. 1.

With reference to FIGS. 1 and 2, an apparatus is assembled in two parts comprising a top piece or cope 1 and a bottom piece or drag 2 which are fastened together by means of clamps 3. The apparatus comprises a cup 4 for receipt of a reactive additive such as a nodularizing agent and for receipt of molten metal to be treated. The cup 4 is defined by a steel shell 5 and is provided with a first outlet 6 leading directly into a reaction chamber 7 which is shown as containing metal additive and which is located immediately below the cup 4. The reaction chamber 7 is defined by refractory side walls 8 and a refractory base 9 and, on one side by a refractory tile 10. The base 9 is designed to slope downwardly towards the refractory tile 10. A second refractory tile 11 is located parallel to the first refractory tile 10 defining these between a channel 12. The arrangement of the two tiles 10 and 11 is such that molten metal from the reaction chamber is caused to flow over the top 13 of the first tile 10 and underneath the bottom 14 of the second tile 11 into an expansion chamber 15 provided with a second outlet 16. The second outlet 16 has a cross-sectional area which is less than that of the first outlet 6 leading from the pouring cup 4 by about 10%. The first tile 10 is shown with a gap 18 below the tile for ease in draining the system.

Figure 3:
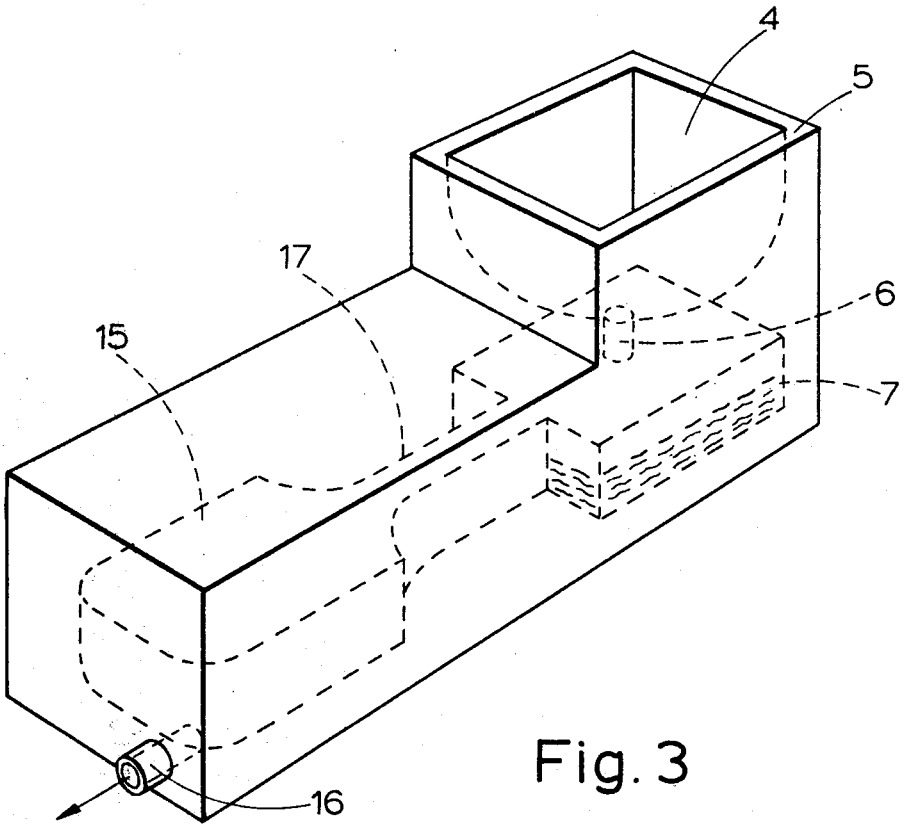
FIG. 3 is a perspective view of another embodiment of an apparatus according to the invention.

Referring to the embodiment illustrated in FIG. 3 the apparatus comprises a cup 4 defined by a steel shell 5 and provided with a first outlet 6 leading directly into a reaction chamber 7 which is shown as containing metal additive. The reaction chamber 7 leads, via a channel 17, to an expansion chamber 15 provided with an outlet 16 having a cross-sectional area which is 10% smaller than the cross-sectional area of the first outlet 6.

The two illustrated embodiments of the apparatus according to the invention are characterised by three particular features. First, the reaction chamber is located immediately below the cup from which both the reactive additive and metal to be treated are introduced. Second, the flow of the metal containing reactive additive from the reaction chamber to the expansion chamber is restricted. In the first embodiment, the restriction is formed by the arrangement of refractory tiles and, in the second embodiment, the restriction is formed by a channel leading from the reaction chamber to the expansion chamber which channel has a restricted cross-sectional area. Third, the cross-sectional area of the outlet from the expansion chamber is less than the cross-sectional area of the outlet from the cup.

In operation, a predetermined amount of reactive additive is introduced into the reaction chamber 7 from the cup 4. Subsequently molten metal is introduced into the reaction chamber 7 via the cup 4 and reacts with the additive. The molten metal containing reactive additive flows from the reaction chamber through the restricted channel 12 between the refractory tiles 10 and 11 (in the embodiment illustrated in FIGS. 1 and 2) or through the restricted channel 17 (in the embodiment illustrated in FIG. 3) into the expansion chamber 15 and thereafter is collected at outlet 16. The relationship between the cross-sectional areas of the outlet from the cup and the outlet from the expansion chamber ensures that a desired head of molten metal is built up in the apparatus. To carry out a subsequent treatment run it is simply necessary to add a further quantity of reactive additive and metal to be treated. There is no need to dissemble the apparatus in order to introduce more reactive additive which is a distinct advantage of the present invention over conventional processes. The apparatus need only be disassembled for periodic cleaning and maintenance.

The invention is illustrated by the following Example.

EXAMPLE

An apparatus was employed as illustrated in FIGS. 1 and 2. Twelve consecutive treatment runs were carried out. A solution factor was set to ensure that the alloy employed as nodularizing agent is dissolved before the last metal passes through the apparatus. The solution factor was calculated in accordance with U.K. Pat. No. 1,511,246 and corresponding U.S. Pat. No. 4,004,630 based on the pouring or treatment time divided by the cross-sectional area of the reaction chamber. In these treatment runs, the solution factor was set between 0.01 and 0.02 depending upon particular production circumstances and the reaction area was 950 $cm^2$.

Some test bars were taken afer 2, 4, 6 or 8 minutes (designated Test Bars 1, 2, 3 and 4 respectively in the following Table) and tested for tensile strength, elongation and hardness.

The results are shown in the following Table in which the reaction indicated as 'good' means that there was no fume or pyrotechnics. Nodularity designated "90K" means that there was at least 90% complete spheroids of graphite in the resulting metal matrix.

| | | | | | | | |
|---|---|---|---|---|---|---|---|
| Base Metal | TC | 3.70 | | | | 3.72 | |
| | Si | 1.14 | | | | 1.14 | |
| | Mn | .31 | | | | .42 | |
| | S | .020 | | | | 0.21 | |
| TREATMENTS | | | | | | | |
| Number | | 1 | 2 | 3 | 4 | 5 | 6 |
| Weight Kgs | | 500 | 500 | 500 | 500 | 500 | 500 |
| Furnace Temp. °C. | | 1510 | 1510 | 1510 | 1510 | 1510 | 1510 |
| Before Chamber °C. | | 1465 | 1470 | 1470 | 1475 | 1480 | 1480 |
| After Treatment °C. | | 1365 | 1380 | 1370 | 1380 | 1400 | 1380 |
| Time secs. | | 70 | 45 | 45 | 50 | 45 | 48 |
| Alloy | | | | | | | |
| Wt. Kgs | | 9 | 9 | 9 | 9 | 9 | 9 |
| Type | | T60 | T60 | T60 | T60 | T60 | T60 |
| % | | 1.8 | 1.8 | 1.8 | 1.8 | 1.8 | 1.8 |
| Reaction | | Good | Good | Good | Good | Good | Good |
| Nodularity Test | | 90K | 90K | 90K | 90K | 90K | 90K |
| Test Bars | | | | | | | |
| | Tensile[1] | 532 | 445 — | — | — | — | |
| | 2 | 534 | — | — | — | — | — |
| | $N/mm^2$ | | | | | | |
| | 3 | — | — | 517 | 526 | 478 | 518 |

-continued

| | | | | | | |
|---|---|---|---|---|---|---|
| 4 | — | — | — | — | — | — |
| Elongation | | | | | | |
| % 1 | 17 | 5 | — | — | — | — |
| 2 | 15 | — | — | — | — | — |
| 3 | — | — | 16 | 18 | 9 | 23 |
| 4 | — | — | — | — | — | — |
| Hardness | | | | | | |
| BHN NO:1 | 143 | 156 | — | — | — | — |
| 2 | 143 | — | — | — | — | — |
| 3 | — | — | 143 | 156 | 149 | 156 |
| 4 — | — | — | — | — | — | |
| Base TC | | 3.71 | 3.71 | 3.71 | 3.71 | 3.71 |
| Metal Si | | 1.08 | 1.08 | 1.08 | 1.08 | 1.08 |
| Mn | | .37 | .37 | .37 | .37 | .37 |
| S | | 0.21 | 0.21 | 0.21 | 0.21 | 0.21 |
| TREATMENTS | | | | | | |
| Number | 7 | 8 | 9 | 10 | 11 | 12 |
| Weight Kgs | 500 | 500 | 500 | 500 | 500 | 500 |
| Furnace Temp °C. Before Box °C. | 1510 | 1510 | 1510 | 1510 | 1510 | 1510 |
| After Treatment °C. | 1480 | 1470 | 1480 | 1470 | 1470 | 1470 |
| Time secs | 1380 | 1370 | 1370 | 1380 | 1380 | 1375 |
| Alloy | 45 | 42 | 42 | 45 | 45 | 46 |
| Wt.Kgs | 9 | 9 | 9 | 9 | 9 | 9 |
| Type* | T60 | T60 | T60 | T60 | T60 | T60 |
| % | 1.8 | 1.8 | 1.8 | 1.8 | 1.8 | 1.8 |
| Reaction | Good | Good | Good | Good | Good | Good |
| Nodularity Test | 90K | 90K | 90K | 90K | 90K | 90K |
| Test Bars | | | | | | |
| Tensile N/mm² 1 | — | — | — | — | — | — |
| 2 | — | — | — | — | — | — |
| 3 | — | — | — | — | — | — |
| 4 | | — | — | — | 507 — | |
| Elongation % 1 | — | — | — | — | — | — |
| 2 — | — | — | — | — | — | |
| 3 | — | — | — | — | — | — |
| 4 — | — | — | — | 20 | — | |
| Hardness BHN No: 1 | —— | — | — | — | — | |
| 2 | — | — | — | — | — | — |
| 3 | — | — | — | — | — | — |
| 4 | — | — | — | — | 146 | — |

*The alloy designated T60 comprises Mg:4.5%; Rare Earth Total 1.8%; Si 48%; Ca 1.0%; balance iron.

We claim:

1. An apparatus for the treatment of molten metal with a reactive additive comprising a reaction chamber and a pouring cup means, the pouring cup means having an outlet means communicating with the reaction chamber for introducing reactive additive and molten metal into the reaction chamber, an expansion chamber communicating via a channel with the reaction chamber and provided with an outlet for molten metal wherein the cross-sectional area of the outlet from the expansion chamber is less than the cross-sectional area of the outlet of the pouring cup means such that molten metal flows through the reaction chamber at a rate which ensures that the reaction chamber is filled to an extent sufficient to cover any reactive additive contained therein.

2. An apparatus according to claim 1, including restricting means for restricting the cross-sectional area of the channel whereby the flow of metal from the reaction chamber to the expansion chamber is controlled.

3. An apparatus according to claim 2, wherein said restricting means comprises refractory tiles disposed between the reaction chamber and the expansion chamber.

4. An apparatus according to any of claims 1 to 3, wherein the reaction chamber is disposed immediately below the pouring cup means.

5. A process for the treatment of molten metal with a reactive additive which comprises introducing a reactive additive via a pouring cup with a first outlet therein into a reaction chamber, introducing molten metal via the said pouring cup and the said first outlet therein into the reaction chamber, causing the molten metal containing reactive additive to flow from the reaction chamber via a restricted channel into an expansion chamber, causing the molten metal to flow from the expansion chamber via a second outlet of cross-sectional area less than that of the said first outlet whereby the flow of molten metal is controlled such that the reaction chamber is filled with molten metal to an extent sufficient to cover the reactive additive contained therein.

6. A process according to claim 5, wherein the reactive additive is a nodularizing agent and the molten metal is molten cast iron.

* * * * *